US009886925B2

(12) United States Patent
Wang et al.

(10) Patent No.: US 9,886,925 B2
(45) Date of Patent: Feb. 6, 2018

(54) APPARATUS FOR ADJUSTING VOLTAGE AT COMMON ELECTRODE AND METHOD THEREOF

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zhiyong Wang, Beijing (CN); Yi Zheng, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 504 days.

(21) Appl. No.: 14/386,576

(22) PCT Filed: Oct. 18, 2013

(86) PCT No.: PCT/CN2013/085473

§ 371 (c)(1),
(2) Date: Sep. 19, 2014

(87) PCT Pub. No.: WO2014/198100

PCT Pub. Date: Dec. 18, 2014

(65) Prior Publication Data

US 2016/0247474 A1 Aug. 25, 2016

(30) Foreign Application Priority Data

Jun. 9, 2013 (CN) ..... 2013 1 0231635

(51) Int. Cl.
*G09G 3/36* (2006.01)

(52) U.S. Cl.
CPC ..... *G09G 3/3655* (2013.01); *G09G 3/3648* (2013.01); *G09G 3/3688* (2013.01);
(Continued)

(58) Field of Classification Search
CPC .. G09G 3/3655; G09G 3/3648; G09G 3/3688; G09G 2300/0413; G09G 2300/043; G09G 2320/0247; G09G 2320/029
See application file for complete search history.

(56) References Cited

U.S. PATENT DOCUMENTS

2004/0046724 A1 3/2004 Woo et al.
2004/0239667 A1* 12/2004 Takahashi ..... G09G 3/3655 345/212

(Continued)

FOREIGN PATENT DOCUMENTS

CN 1489375 A 4/2004
CN 1527271 A 9/2004

(Continued)

OTHER PUBLICATIONS

First Chinese Office Action dated Jun. 28, 2016; Appln. No. 201310231635.8.

(Continued)

*Primary Examiner* — Ariel Balaoing
(74) *Attorney, Agent, or Firm* — Ladas & Parry LLP

(57) ABSTRACT

Disclosed an apparatus for adjusting a voltage at a common electrode, including: a signal processing module configured to superpose a pixel voltage value of a pixel unit and a voltage value of a common electrode and output a superposed signal; a comparison module configured to receive the superposed signal output from the signal processing module, compare the superposed signal with a voltage at a ground terminal, and output a control signal; and a driving module configured to receive the control signal output from the (Continued)

comparison module and adjust the voltage value of the common electrode by the control signal. Also disclosed is a method for adjusting a voltage at a common electrode. The present disclosure can obtain a stable voltage at a pixel electrode and avoid flickers in pictures, and in turn the voltage at the common electrode can be adjusted automatically, which saves the human resource and increases working efficiency.

13 Claims, 2 Drawing Sheets

(52) U.S. Cl.
CPC ..... *G09G 2300/043* (2013.01); *G09G 2300/0413* (2013.01); *G09G 2320/029* (2013.01); *G09G 2320/0219* (2013.01); *G09G 2320/0247* (2013.01)

(56) References Cited

U.S. PATENT DOCUMENTS

| | | | | |
|---|---|---|---|---|
| 2006/0066553 | A1* | 3/2006 | Deane | G09G 3/3648 345/98 |
| 2008/0198124 | A1 | 8/2008 | Kojima et al. | |
| 2008/0309861 | A1 | 12/2008 | Seki et al. | |
| 2009/0079724 | A1* | 3/2009 | Dou | G09G 3/3611 345/212 |
| 2013/0069928 | A1* | 3/2013 | Mizusako | G09G 3/3611 345/212 |

FOREIGN PATENT DOCUMENTS

| | | | |
|---|---|---|---|
| CN | 101324720 | A | 12/2008 |
| CN | 101395550 | A | 4/2009 |
| JP | 08278485 | A | 10/1996 |
| JP | 2000-276111 | A | 10/2000 |
| KR | 20080076805 | A | 8/2008 |

OTHER PUBLICATIONS

International Search Report Appln. No. PCT/CN2013/085473; dated Mar. 3, 2014.
International Preliminary Report on Patentability dated Dec. 15, 2015; PCT/CN2013/085473.
Second Chinese Office Action dated Feb. 20, 2017; Appln. No. 201310231635.8.

* cited by examiner

APPARATUS FOR ADJUSTING VOLTAGE AT COMMON ELECTRODE AND METHOD THEREOF

TECHNICAL FIELD

The present disclosure relates to a field of liquid crystal display technique, and more particularly to an apparatus for adjusting a voltage at a common electrode and a method thereof.

BACKGROUND

In an existing liquid crystal display, there is a capacitance between a gate and a source in a Thin Film Transistor (TFT)/Thin Film Field Effect Transistor switch. When the TFT switch is turned off, a voltage at the gate transits to a low level from a high level, but because of the existence of the capacitance between the gate and source, a capacitance coupling effect would pull a voltage at a pixel electrode (that is, a pixel voltage) down, which may deviate from a voltage given by a system, such that a deflection direction of the liquid crystal is affected and a transmittance is changed. Also, because the liquid crystal is driven by a polarity inversion of the voltage, human's eyes would perceive flickers in a picture if there is a difference between the transmittance of the liquid crystal as a positive voltage drives and that as a negative voltage drives, and a long time flicker would causes discomfort to the human's eyes.

In order to settle the problem of flickers in the picture, the prior art adjusts a voltage at a common electrode manually, that is, a compensation for the pixel voltage is achieved by adjusting the voltage value of the common electrode, and in particular, the adjustment is performed manually and real-time by a personal computer, etc, connected to a driving Integrated Circuit (IC). For example, the adjustment on the voltage at the common electrode is performed by changing programs and the like in real-time. Meanwhile, a standard flicker detection device is further required in order to eliminate errors among operators. It can be seen that the current implementing methods not only waste human resource but also have low working efficiency.

SUMMARY

In view of this, the present disclosure provides an apparatus for adjusting a voltage at a common electrode and a method thereof, which are capable of adjusting the voltage at the common electrode automatically and increasing working efficiency.

Solutions utilized in embodiments of the present disclosure are as follows.

There is provided an apparatus for adjusting a voltage at a common electrode, comprising:

a signal processing module configured to superpose a pixel voltage value of a pixel unit and a voltage value of a common electrode and output a superposed signal;

a comparison module configured to receive the superposed signal output from the signal processing module, compare the superposed signal with a voltage at a ground terminal, and output a control signal; and a driving module configured to receive the control signal output from the comparison module and adjust the voltage value of the common electrode by the control signal.

Optionally, the pixel unit is a preset dummy pixel unit.

Optionally, the dummy pixel unit is disposed at an edge position of an array substrate, which has a same structure and connection relationship as an existing pixel unit on the array substrate.

Optionally, the signal processing module comprises:

an adder configured to perform an addition operation on the pixel voltage value of the pixel unit and the voltage value of the common electrode and transfer a result of operation to an integrator; and the integrator configured to perform an integration calculation on the result of operation from the adder and transfer a result of calculation to the comparison module.

Optionally, the comparison module comprises a comparator configured to compare a result of the integration calculation received from the integrator with the voltage at the ground terminal and transfer a result of comparison to the driving module.

Optionally, the driving module is configured to adjust the voltage value of the common electrode when the superposed value of the pixel voltage value of the pixel unit and the voltage value of the common electrode is different from the voltage value of the ground terminal.

Optionally, the driving module is configured to store the current voltage value of the common electrode when the superposed value of the pixel voltage value of the pixel unit and the voltage value of the common electrode is identical with the voltage value of the ground terminal.

The present disclosure further provides a method for adjusting a voltage at a common electrode, and the method comprising steps as follows:

superposing a pixel voltage value of a pixel unit and a voltage value of the common electrode and outputting a superposed signal;

comparing the superposed signal with a voltage at a ground terminal, and outputting a control signal; and adjusting the voltage value of the common electrode by the control signal.

Optionally, the step of superposing a pixel voltage value of a pixel unit and a voltage value of the common electrode may particularly comprise:

performing an addition operation on the pixel voltage value of the pixel unit and the voltage value of the common electrode and then performing an integration on a result of the addition operation.

Optionally, the step of adjusting the voltage value of the common electrode by the control signal may particularly comprise:

increasing the voltage value of the common electrode if the superposed voltage value is greater than the voltage value of the ground terminal, and decreasing the voltage value of the common electrode if the superposed voltage value is smaller than the voltage value of the ground terminal.

Optionally, the current voltage value of the common electrode is stored when the superposed voltage value of the pixel voltage value of the pixel unit and the voltage value of the common electrode is identical with the voltage value of the ground terminal.

In the apparatus for adjusting the voltage at the common electrode and method thereof according to the embodiments of the present disclosure, the dummy pixel unit is disposed at the edge position of the array substrate, and the dummy pixel unit is as same as existing pixel unit on the array substrate and has same connection relationship as the existing pixel unit, therefore it has same pixel voltage as the existing pixel unit. In an actual operation, the pixel voltage value of the pixel unit and the voltage value of the common electrode are superposed and a superposed signal is output; the superposed signal is compared with the voltage at the ground terminal, and a control signal is output; the voltage value of the common electrode is adjusted by the control signal. In particular, if the superposed voltage value is determined to not be zero, the voltage value of the common electrode is adjusted by the driving integrated circuit until the superposed voltage value is zero. If the superposed value is just zero, it is proved that the compensation for the voltage value of the common electrode is correct, thus achieving the effect that a voltage at the pixel electrode is stable and the flickers in the pictures are avoided. Further, the adjustment process for the voltage at the common electrode according to the present disclosure requires no human intervention and can be performed automatically by the combination of the disposed apparatus for adjusting the voltage at the common electrode and the driving IC, thus saving the human resource and increasing the working efficiency without any errors among the operators.

REFERENCE SIGNS

1—dummy pixel unit; 2—pixel unit; 3—driving module; 4—signal processing module; 5—adder; 6—integrator; 7—comparator; 8—comparison module.

DETAILED DESCRIPTION

A basic concept of the present disclosure is as follows: a pixel voltage value of a pixel unit and a voltage value of a common electrode are superposed and a superposed signal is output; the superposed signal is compared with a voltage at a ground terminal, and a control signal is output; and the voltage value of the common electrode is adjusted by the control signal. An automatic adjustment for the voltage at the common electrode is realized by taking a difference between the pixel voltage and the voltage at the common electrode as a condition.

In an example, the pixel unit is a preset dummy pixel unit, which is disposed at the edge position of an array substrate, and the dummy pixel unit is as same as existing pixel units on the array substrate and has same connection relationship as the existing pixel units. The edge of the array substrate corresponds to opaque positions around a display panel.

The present disclosure would be described in details below in connection with drawings and embodiments.

Figure 1:
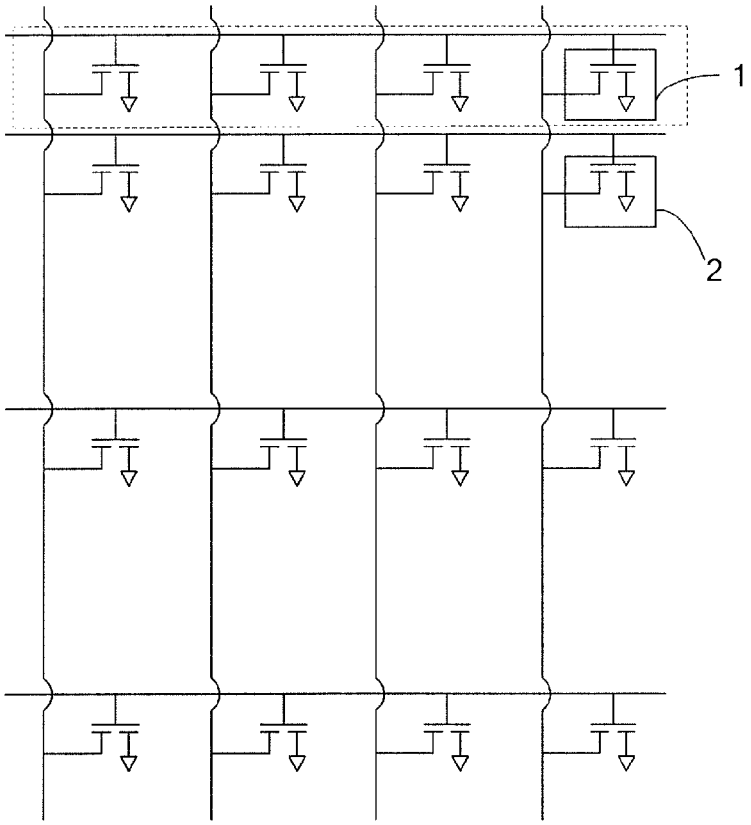
FIG. 1 is an exemplary view illustrating a planar structure of an array substrate on which dummy pixel units are disposed according to embodiments of the present disclosure.

FIG. 1 is an exemplary view illustrating a planar structure of an array substrate on which dummy pixel units are disposed according to embodiments of the present disclosure. As illustrated in FIG. 1, a row of dummy pixel units 1 are disposed on an edge position (a position denoted by a dotted box) on the array substrate, the dummy pixel units 1 are same as the existing pixel units 2 on the array substrate, and a connection relationship between the dummy pixel units with data lines and gate lines is same as that for the pixel units 2; that is to say, for the dummy pixel unit 1, a gate of a TFT is connected with a gate line and source thereof is connected with a data line. Therefore, a pixel voltage of the dummy pixel unit 1 has a same value as that of the pixel unit 2. Herein, the dummy pixel unit 1 is disposed in order to prevent the performance of the existing pixel units from being affected during the adjustment process, namely to prevent a display quality of the display panel from being affected. As an example, only one row of dummy pixel units may be disposed herein.

Figure 2:
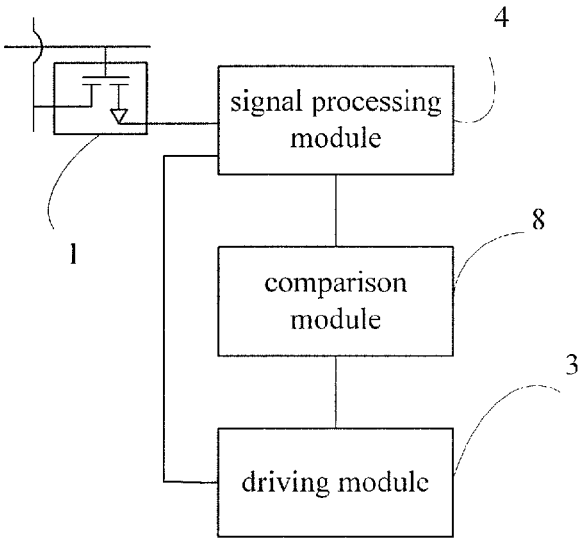
FIG. 2 is an exemplary view illustrating a structure of an apparatus for adjusting a voltage at a common electrode according to the embodiments of the present disclosure.

FIG. 2 is an exemplary view illustrating a structure of an apparatus for adjusting a voltage at a common electrode according to the embodiments of the present disclosure. As illustrated in FIG. 2, the apparatus comprises a signal processing module 4, a comparison module 8 and a driving module 3.

The signal processing module 4 is configured to superpose a pixel voltage value of a pixel unit and a voltage value of a common electrode and output a superposed signal.

In an example, the signal processing module 4 is connected with an output terminal of the dummy pixel unit 1, and is connected with the driving module 3, and is configured to acquire the pixel voltage value of the pixel unit and the voltage value of the common electrode.

The comparison module 8 is configured to receive the superposed signal output from the signal processing module 4, to compare the superposed signal with a voltage at a ground terminal, and output a control signal. The voltage at the ground terminal is zero in the present embodiment.

The driving module 3 is configured to receive the control signal output from the comparison module 8 and adjust the voltage value of the common electrode by the control signal.

Particularly, the driving module 3 is configured to adjust the voltage value of the common electrode when the superposed value of the pixel voltage value of the pixel unit and the voltage value of the common electrode is not zero. Ideally, the pixel voltage values are distributed symmetrically with respect to a numerical value line of the common voltage, that is, the superposed value of the pixel voltage value and the common voltage value is zero. If the superposed voltage value is determined to be greater than zero, it is proved that the compensation for the voltage at the common electrode is insufficient, therefore the voltage value of the common electrode is increased; and if the superposed voltage value is determined to be smaller than zero, it is proved that the compensation for the voltage at the common electrode is too much, therefore the voltage value of the common electrode needs to be decreased.

In the embodiment shown in FIG. 2, the driving module 3 may implement the adjustment of the voltage value of the common electrode with a driving IC.

Optionally, the driving module 3 is further configured to store the current voltage value of the common electrode when the superposed value of the pixel voltage value of the pixel unit and the voltage value of the common electrode is identical with zero.

Thus, the pixel voltage may be compensated according to the voltage at the common electrode thereafter in order to achieve a beneficial effect in which flickers in pictures are avoided. For example, the driving IC may write the present the voltage value of the common electrode into a read only memory in the driving IC by a probe station. It should be noted that, because the pixel voltage value would alternate between positive and negative with an alter-current driving voltage of the liquid crystal, it is proved that the compensation for the voltage value of the common electrode is correct if the superposed value of the pixel voltage value and the voltage value of the common electrode is just zero.

Figure 3:
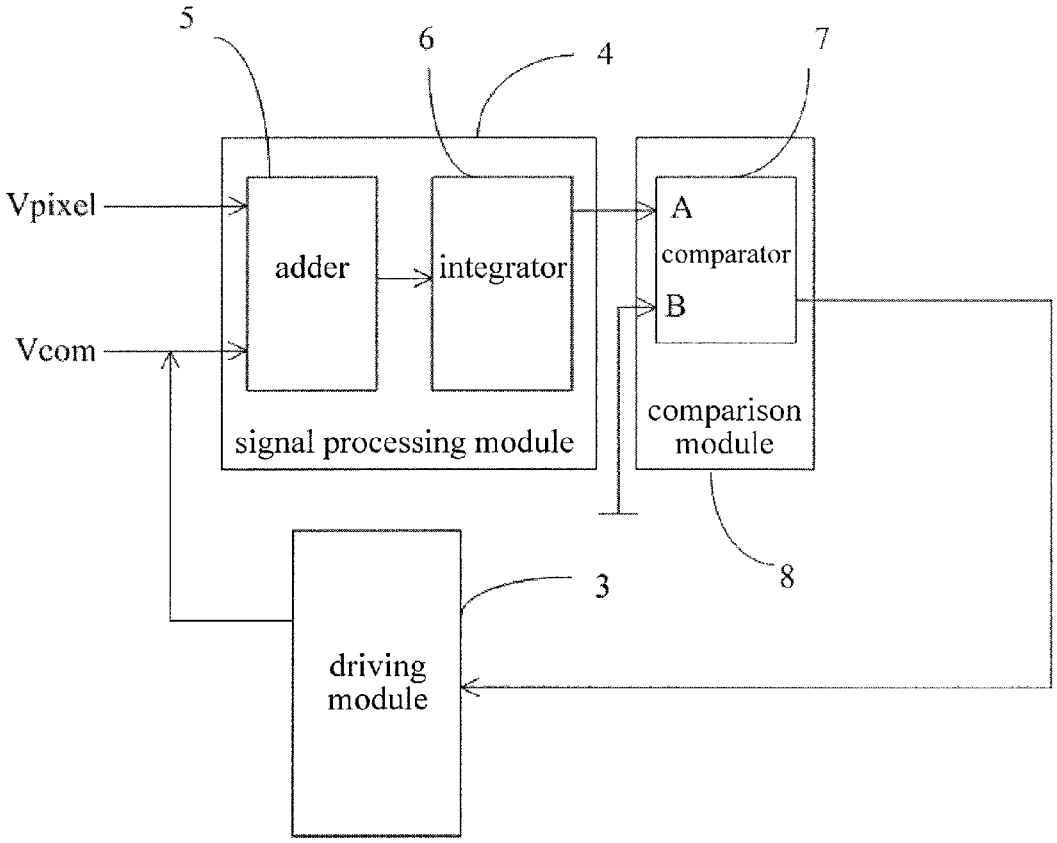
FIG. 3 is a detailed structure diagram of the apparatus for adjusting the voltage at the common electrode according to the embodiments of the present disclosure.

FIG. 3 is a detailed structure diagram of the apparatus for adjusting the voltage at the common electrode according to the embodiments of the present disclosure. As illustrated in FIG. 3, the signal processing module 4 comprises an adder 5 and an integrator 6, and the comparison module 8 comprises a comparator 7. In an example, a voltage (Vpixel) at the pixel electrode of the dummy pixel unit (not shown in FIG. 3) and the voltage (Vcom) at the common electrode imported from the driving module are connected with input terminals of the adder, an output terminal of the adder 5 is connected with an input terminal of the integrator 6, an output terminal of the integrator 6 is connected with one input terminal of the comparator 7, and the other input terminal of the comparator 7 is grounded, namely has a zero voltage; and an output terminal of the comparator 7 is connected with the driving module 3.

The adder 5 is configured to perform an addition operation on the pixel voltage value of the pixel unit and the voltage value of the common electrode and transfer a result of operation to the integrator. In an example, the adder actually performs a subtraction operation on the pixel voltage value of the pixel unit and the voltage value of the common electrode, that is, the pixel voltage value and the voltage value of the common electrode with a minus sign are added. The utilized adder may be implemented with an existing addition operation circuit.

The integrator 6 is configured to perform an integration calculation on the result of the addition operation and transfer a result of calculation to the comparison module. The utilized integrator may be implemented with an existing integrator operation circuit.

The comparator is configured to receive and compare the result of integration calculation transferred from the integrator with the voltage at the ground terminal and transfer a result of comparison to the driving module.

Optionally, the adder, the integrator and the comparator in the present disclosure may be integrated into the driving IC.

The embodiments of the present disclosure further provides a method for adjusting a voltage at a common electrode, and the method comprising steps as follows:

superposing a pixel voltage value of a pixel unit and a voltage value of the common electrode and outputting a superposed signal; comparing the superposed signal with a voltage at a ground terminal, and outputting a control signal; and adjusting the voltage value of the common electrode by the control signal.

In an example, the step of superposing a pixel voltage value of a pixel unit and a voltage value of the common electrode may particularly comprise:

performing an addition operation on the pixel voltage value of the pixel unit and the voltage value of the common electrode and then performing an integration on a result of the addition operation.

In an example, the step of adjusting the voltage value of the common electrode by the control signal may particularly comprise:

increasing the voltage value of the common electrode if the superposed voltage value is greater than zero, and decreasing the voltage value of the common electrode if the superposed voltage value is smaller than zero.

In an example, the pixel unit is a preset dummy pixel unit, which is disposed at an edge position of the array substrate, and the dummy pixel unit is as same as existing pixel unit on the array substrate and has same connection relationship as the existing pixel unit.

In an example, the method further comprises a step of storing the current voltage value of the common electrode if the superposed voltage value of the pixel voltage value of the pixel unit and the voltage value of the common electrode is zero.

In an example, the step of storing the current voltage value of the common electrode may particularly comprise:

writing the current voltage value of the common electrode into a read only memory in the driving IC by means of a probe station.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. An apparatus for adjusting a voltage at a common electrode, comprising:

a signal processing module configured to superpose a pixel voltage value of a preset dummy pixel unit and a voltage value of a common electrode and output a superposed signal;

a comparison module configured to receive the superposed signal output from the signal processing module, compare the superposed signal with a voltage at a ground terminal, and output a control signal; and a driving module configured to receive the control signal output from the comparison module and adjust the voltage value of the common electrode by the control signal;

wherein the signal processing module comprises:

an adder configured to perform an addition operation on the pixel voltage value of the preset dummy pixel unit and the voltage value of the common electrode and output a result of operation.

2. The apparatus of claim 1, wherein the preset dummy pixel unit is disposed at an edge position of an array substrate, which has a same structure and connection relationship as an existing pixel unit on the array substrate.

3. The apparatus of claim 1, wherein the signal processing module further comprises:

an integrator configured to perform an integration calculation on the result of operation output from the adder and transfer a result of calculation to the comparison module.

4. The apparatus of claim 3, wherein the comparison module comprises a comparator configured to compare a result of the integration calculation received from the integrator with the voltage at the ground terminal and transfer a result of comparison to the driving module.

5. The apparatus of claim 1, wherein the driving module is configured to adjust the voltage value of the common electrode when a superposed value of the pixel voltage value of the preset dummy pixel unit and the voltage value of the common electrode is different from the voltage value of the ground terminal.

6. The apparatus of claim 1, wherein the driving module is configured to store a current voltage value of the common electrode when a superposed value of the pixel voltage value of the preset dummy pixel unit and the voltage value of the common electrode is identical with the voltage value of the ground terminal.

7. A method for adjusting a voltage at a common electrode, comprising steps as follows:

superposing a pixel voltage value of a preset dummy pixel unit and a voltage value of the common electrode and outputting a superposed signal;

comparing the superposed signal with a voltage at a ground terminal, and outputting a control signal; and adjusting the voltage value of the common electrode by the control signal;

wherein the step of superposing a pixel voltage value of a preset dummy pixel unit and a voltage value of the common electrode comprises:

performing an addition operation on the pixel voltage value of the preset dummy pixel unit and the voltage value of the common electrode and outputting a result of an addition operation.

8. The method of claim 7, wherein the step of superposing a pixel voltage value of a preset dummy pixel unit and a voltage value of the common electrode further comprises:

performing an integration on a result of the addition operation.

9. The method of claim 7, wherein the step of adjusting the voltage value of the common electrode by the control signal comprises:

increasing the voltage value of the common electrode if a superposed voltage value is greater than the voltage value of the ground terminal, and decreasing the voltage value of the common electrode if the superposed voltage value is smaller than the voltage value of the ground terminal.

10. The apparatus of claim 2, wherein the signal processing module further comprises:

an integrator configured to perform an integration calculation on the result of operation output from the adder and transfer a result of calculation to the comparison module.

11. The apparatus of claim 10, wherein the comparison module comprises a comparator configured to compare a result of the integration calculation received from the integrator with the voltage at the ground terminal and transfer a result of comparison to the driving module.

12. The apparatus of claim 2, wherein the driving module is configured to adjust the voltage value of the common electrode when a superposed value of the pixel voltage value of the preset dummy pixel unit and the voltage value of the common electrode is different from the voltage value of the ground terminal.

13. The apparatus of claim 2, wherein the driving module is configured to store a current voltage value of the common electrode when a superposed value of the pixel voltage value of the preset dummy pixel unit and the voltage value of the common electrode is identical with the voltage value of the ground terminal.

* * * * *